United States Patent [19]

Paroty

[11] 4,060,373

[45] Nov. 29, 1977

[54] GAS LIGHTER

[75] Inventor: Jean-Marie Paroty, Ableiges, France

[73] Assignee: Societe Franco-Hispano-Americaine (FRANCISPAM), Saint-Gratien, France

[21] Appl. No.: 670,102

[22] Filed: Mar. 25, 1976

[51] Int. Cl.[2] ..... F23Q 2/08

[52] U.S. Cl. ..... 431/135; 431/129; 431/131; 431/136

[58] Field of Search ..... 431/129, 130, 135, 131, 431/132, 277, 344, 136

[56] References Cited

U.S. PATENT DOCUMENTS

| | | | |
|---|---|---|---|
| 2,957,328 | 10/1960 | Gellman | 431/130 |
| 3,453,064 | 6/1969 | Goto | 431/131 |
| 3,484,825 | 12/1969 | Hocq | 431/131 X |
| 3,528,759 | 9/1970 | Newman | 431/129 |
| 3,695,814 | 10/1972 | Genoud | 431/131 |

FOREIGN PATENT DOCUMENTS

| | | | |
|---|---|---|---|
| 965,970 | 4/1975 | Canada | 431/277 |
| 1,390,072 | 4/1975 | United Kingdom | 431/130 |

*Primary Examiner*—Edward G. Favors
*Assistant Examiner*—Larry Jones
*Attorney, Agent, or Firm*—Brisebois & Kruger

[57] ABSTRACT

Lighter using liquefied gas under pressure comprises a casing, a cap for said casing, a reservoir provided with a valve leading to a burner, and an ignition mechanism comprising an abrasive wheel, a flint biassed against the abrasive wheel, and valve control means actuated by the movement of said cap through a spring, one part of which spring is connected to the cap to hold it in either open or closed position and the other part of which spring is adapted to be displaced by the movement of the spring part connected to the cap and cooperates with the valve to open the valve during opening of the cap. The spring also comprises a third part cooperating with the flint to bias said flint against the abrasive wheel.

15 Claims, 6 Drawing Figures

GAS LIGHTER

SUMMARY OF THE INVENTION

This invention relates to a lighter utilizing liquefied gas under pressure as its fuel. This lighter is of the type comprising, within a casing, a reservoir equipped with an outlet valve leading to a burner, and an ignition mechanism comprising an abrasive wheel and a flint biassed against the wheel, together with means for actuating the valve controlled by the movement of a cap for the casing.

Lighters are already known which comprise an elastic member or spring attached to the cap to hold the cap in an open or closed position. This member also serves to open or close the fuel valve.

These lighters are, however, relatively complex, so as to make them difficult to assemble and reduce their reliability in service.

The present invention proposes to overcome these disadvantages and provide a new lighter comprising a smaller number of easily manufactured parts, thus permitting a simpler assembly. In particular, the invention proposes to provide a new lighter in which the reservoir and the ignition mechanism may be easily introduced into a casing and operatively connected to a cap for said casing. The invention also proposes, as a consequence of this simplification, to make certain parts, conventionally made of metal, from less expensive materials which are easier to work. A further object of the invention is to improve the reliability of the lighter by reducing the causes for breakdown or deterioration.

More particularly, the invention proposes to simplify the structure of the parts of the ignition mechanism and the opening mechanism and to insure a good synchronization of the operation of these two mechanisms. A final object of the invention is to increase the useful life of the spring means used for various operations in the lighter.

This spring is advantageously positioned so as to decrease or even eliminate its pressure against the flint when the cap is in a closed position, thus increasing its useful life.

In a preferred embodiment of the invention the spring is connected to the cap so as to be readily removable, for example, by means of an end projecting into a notch in a member fixed to the cap.

Advantageously, in such an embodiment, the ignition mechanism may be fixed to the reservoir, so that the reservoir-mechanism assembly may be simply introduced from the top into a casing preferably having a fixed bottom, latching means being provided at the level of the mechanism to attach the reservoir-mechanism assembly to the casing, and then connect an appropriate part of the spring to the cap of the casing. Disassembly may be effectuated in an inverse succession of steps in an equally rapid manner.

Preferably the spring has, on opposite sides of a central part, a first part cooperating with the flint, preferably through a flint lever, and another part connected to the cap so as to be displaced by pivoting of the cap while holding the latter in either an open position or a closed position, the central part being displaceable by the other part and urged against the movable part of the valve.

In a particularly advantageous embodiment, the spring may be a torsion spring and have at least one spiral portion to increase its elasticity.

Thus, in an improved form of the invention, the spring may have an arm, one end of which is connected to a part fixed to the cap, said arm leading to a spiral part comprising a plurality of coils, which in turn leads to a central part which is biassed against the movable part of the valve. This central part leads to another spiral part positioned, for example, around the axis of the flint lever, and the end of which is fixed to the flint lever.

In a preferred embodiment of the invention the mechanism comprises a member called a "platform," preferably made from a single piece of plastic material, positioned at the top of the reservoir, and having the shape of a small block carrying a flint guide, the pivot pin of the flint lever, and a device for fastening the mechanism to the casing. This small block is also traversed by the burner.

Preferably, the upper part of the platform extends to the level of the upper end of the body of the casing, that is to say to the junction between the body and the cap, and defines the flint guide equipped with a lateral orifice for introducing the flints, which is directly accessible when the cap is open.

In a particular embodiment, the platform has a slot through which the upper part of the flint lever extends, this upper part being then visible above the upper surface of the small block so that it may be manually actuated. In an advantageous manner, the upper surface of the small block may have a mark before which the upper part of the flint lever moves so as to indicate the degree of wear on the flint.

Owing to a particular characteristic of the invention, the means for fastening the mechanism to the casing may advantageously comprise a pivoted rod having at its upper end means permitting its rotation, such for example, as a screw head, and at its lower end an arm which, upon rotation of the rod, comes into position beneath an upward projection on the casing so as to hold the mechanism in the casing.

In an especially advantageous embodiment, the hinge between the cap and the casing body may be made by stamping followed by rolling, one of the members of the hinge being integral with the cap and the other integral with the body of the lighter, said members being then aligned to permit the passage of a pivot pin through them. In this case, the cap preferably carries on its two major lateral surfaces, on opposite sides of the hinge member, two projections which are substantially semicircular in shape and which cooperate with two recesses in the two major lateral faces of the lighter body. The position of the members of the hinge of the cap is slightly displaced with respect to these projections and their corresponding recesses so that the pin may be introduced without difficulty through the assembled hinge members. After introduction of the pin, the members of the hinge with their common pin are bent inwardly of the lighter so that the ends of the pin come into alignment with the projections of the cap seated in the corresponding recesses in the casing, which prevents any accidental separation of the pivot pin. Of course, the projections may be carried by the body of the lighter and the corresponding recesses by the cap.

Other advantages and characteristics of the invention will appear from a reading of the following description, given purely by way of example, with reference to the accompanying drawings, in which.

Figure 2:
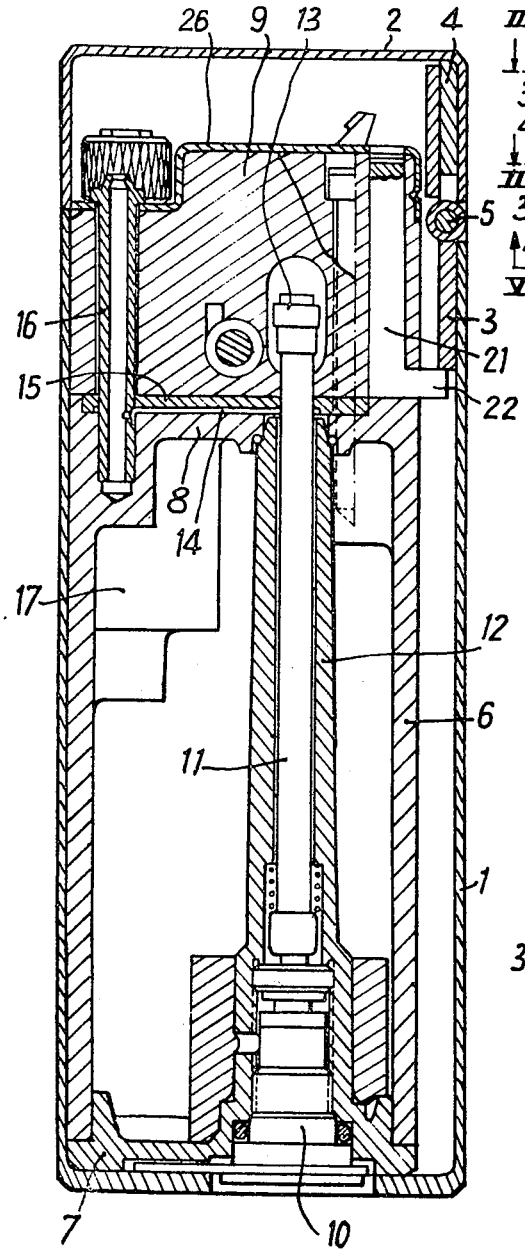
FIG. 2 is a sectional view taken along the line II—II of FIG. 1.

The illustrated lighter has a casing 1 in the shape of a parallelopiped, and is made for example of metal. It has an upper cap 2 registering exactly with the body 1 so as to impart to the assembled lighter the appearance of a parallelopipedic rectangle, elongated in height.

The cap 2 is pivotally attached to the body 1 by a hinge of a conventional type having one part 3 attached to the inside of the box 1 and a second part 4 attached to the inside of the cap 2, the two parts 3 and 4 being connected by a pivot pin 5.

Inside the body of the box 1 is an assembly comprising a reservoir 6 made of plastic material, provided with a separate bottom 7 and upper wall 8, and a mechanism comprising a platform in the form of a block of plastic material 9. The bottom 7 of the reservoir has, in registration with an orifice in the bottom of the casing 1, a combined filling outlet and adjusting valve 10 which makes it possible to recharge the reservoir with fuel and to adjust the height of the flame.

Figure 5:
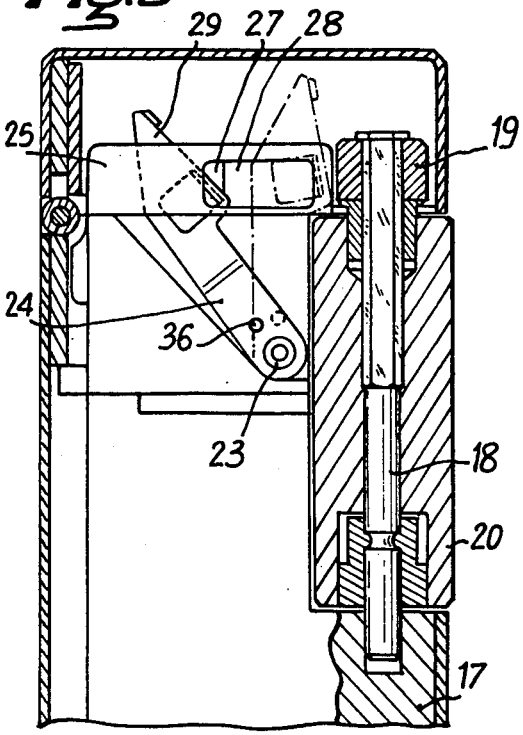
FIG. 5 is a sectional view taken along the line V—V of FIG. 1.

This valve 10, of a type known in itself, carries an upwardly extending rod 11 loosely positioned in the chimney 12 passing through the reservoir. Rod 11 emerges above the reservoir in the form of a head 13 located in a corresponding cavity in the block 9. Lifting of this head permits opening of the valve 10 and the passage of gas through a space between the rod 11 and the chimney 12, which space may be connected at its upper end to the burner 16 (which passes through the block 9) by a duct 14 formed between the wall 8 and a sealing member 15 positioned on the wall 8. The reservoir 6 also has at its upper end a bulge 17 in which the pivot pin 18 (FIG. 5) of the abrasive wheel 19 is seated. This pin supports a cylindrical actuator 20 (FIG. 1) which permits rotation of the abrasive wheel. This actuator projects through a slot in the corresponding corner of the casing 1.

The block 9 has an opening which receives a cylindrical rod 21 (FIG. 2) the upper part of which has the shape of a screw head and the lower part of which has a lateral arm 22 which may be brought, by rotation of the rod 21, beneath part of the hinge 3 so as to immobilize the mechanism-reservoir assembly in the casing 1.

The small block 9 also has a transverse pin 23 (FIG. 5) about which a flint lever 24 is mounted to swing. The upper end of this lever passes through a flint guide 25 projecting from the upper part of the platform 9 and extending beneath a metal reinforcing plate 26 attached to the small block 9. This guide has a lateral window 27 through which a flint 28 may be introduced when the lever is swung completely away from the abrasive ring 19.

Figure 1:
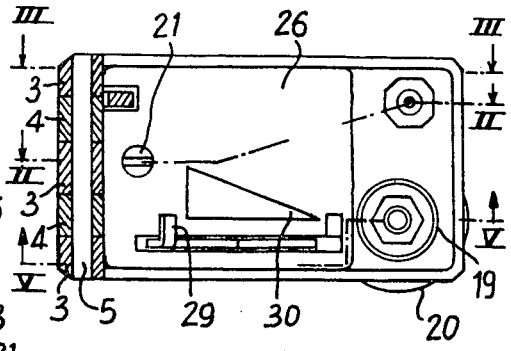
FIG. 1 is a top plan view of the lighter with the cap removed.

As will be seen in FIG. 1, the upper end of the lever 24 has a nose flange 29 emerging above the plate 26 through a slot formed in this plate and capable of movement relative to a mark 30 which is triangular in shape and adapted to indicate the wear of the flint as a function of the position of the nose plate 29 relative to this triangle.

The cap 2 is held in open and closed position by means of a spring according to the invention. The first arm 31 of this spring is substantially vertical and hooked so as to be readily inserted in and removed from a slot in a member 32 fixed to the hinge 4. The arm 31 is carried by a central part comprising first a spiral portion 33 and then a bent arm 34. The arm 34, when the cap 2 is closed, is positioned near the lower face of the head of the valve 13.

The spring also comprises a second, spirally wound part 35, the free end 36 of which is bent away from the plane of the spring and forms a projection penetrating into a corresponding orifice in the lever 24 to fasten the end 36 to that lever.

Figure 3:
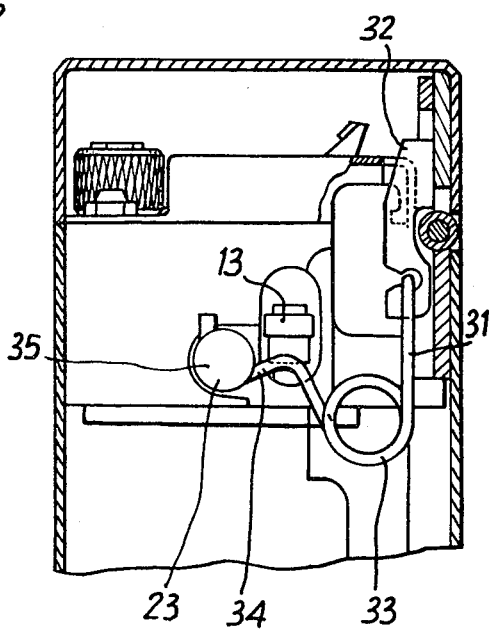
FIGS. 3 and 4 are sectional views taken along the line III—III of FIG. 1, with the cap closed and opened respectively.
Figure 4:
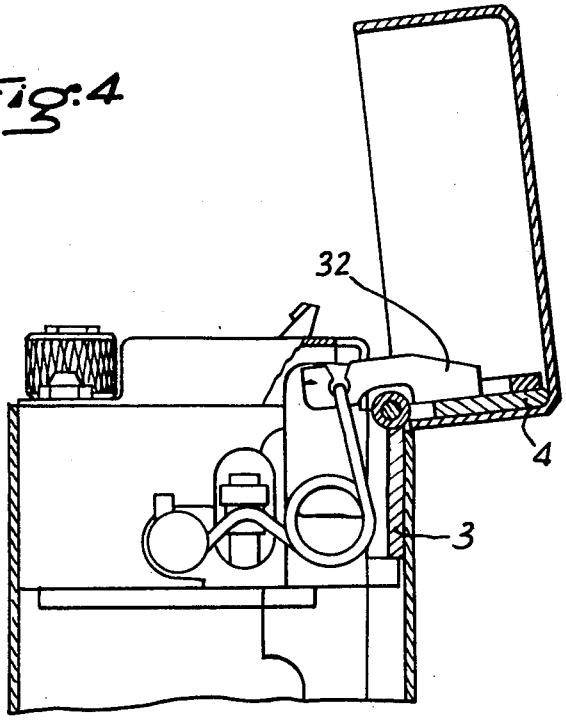

When the cap is closed as shown in FIG. 3 and the user moves it into the open position shown on FIG. 4, he must first overcome the resistance of the arm 31 of the spring which is biassed away from the arm 34 and thus tends to hold the cap in its closed position.

As the cap opens, the arm 34 follows the pivotal movement of the part 32 and compresses the spiral part 33, and the portion 34 rises as shown on FIG. 4. In this rising movement portion 34 draws with it upwardly the head 13 which, through rod 11, actuates the valve 10 and permits the gas contained in the reservoir to escape to the burner 16. When the cap reaches its completely open position shown in FIG. 4, the arm 31 of the spring which is biassed away from the arm 34, tends to urge the cap 4 horizontally outward through the member 32 so that the pivoted cap 4 is retained in its open position.

The user may then, by turning the abrasive wheel 19, ignite the gas and use the lighter. It will also be appreciated that in this opening movement the pressure of the spring on the flint 28 is increased.

When the user, acting on the cap 4, closes this cap against the resistance of the arm 31 of the spring, an inverse movement is produced, and the portion 34 returns to the position of FIG. 3 and consequently the head 13 is released and the valve closes.

Moreover, throughout the movement of the spring during the opening and closing of the cap, the spiral portion 35 of the spring remains in place around the pin 23 and through the projection 36 urges the flint lever toward the abrasive wheel 19.

It will be appreciated that, as a consequence of the extremely simple conception of the mechanism, the latter may comprise a platform 9 made simply of plastic material, which consinderably facilitates the manufacture of the platform, which always has a relatively complex shape. In effect, the platform is not subjected to substantial forces and serves only to support the axis of the flint lever. The relatively substantial forces arising from the abrasive wheel are transferred to the upper plate 26 in which the wheel bearing is located, and the opening and closing forces of the cap are transmitted to the pin 23 only through a progressive spring which does not cause substantial strains.

The mechanism may be introduced into the casing in an extremely simple manner. The cap of the empty casing is moved to its open position and the reservoir 6 and the platform 9 which carries the spring are introduced into the casing from the top. It should be noted that, when the arm 31 of the spring is released from the slot in the member 32, the arm 34 remains in lowered position and leaves the valve closed. The latching device 21 is then turned and the end 31 introduced into the slot in the member 32, which has the further effect of raising the head 13. It then suffices to close the cap and the lighter is assembled. Disassembly takes place in a reverse sequence in an equally short time.

Figure 6:
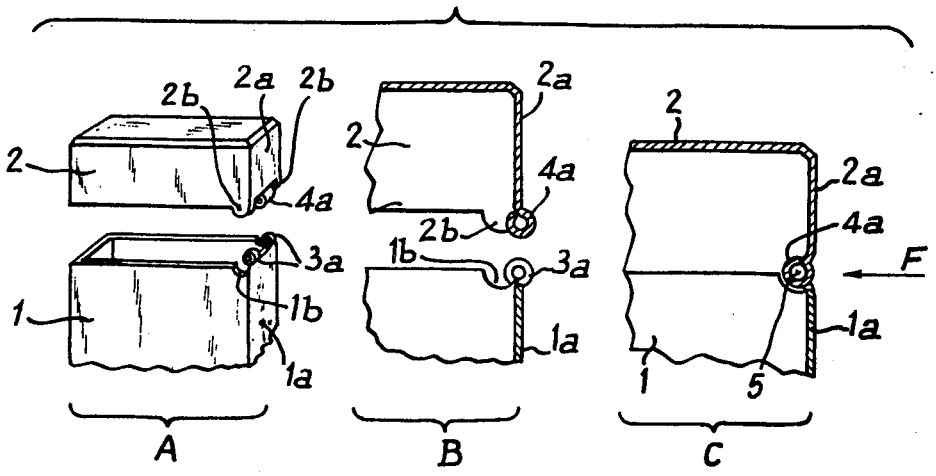
FIG. 6 is a schematic view showing the assembly of the box and the cap according to one embodiment of the invention, with view A showing the cap and the body of the casing separated, view B showing a transverse cross-section in the position of FIG. A, and view C the same section after assembly.

Referring now to FIG. 6, it will be seen that the rear face 2*a* of the cap 2 comprises a central part 4*a* of the hinge, which is formed by stamping and then rolling. It will also be seen that the rear surface 1*a* of the body of the lighter 1 has two hinge parts 3*a* also formed by stamping and rolling, spaced from each other so as to receive the member 4*a* between them. It will also be seen that the two lateral surfaces positioned on opposite sides of the cap 2 have two substantially semicircular projections 2*b*, while the corresponding surfaces of the body 1 have two recesses 1*b* of complementary shape. Referring more particularly to view 2B, the projections 2*b* and recesses 1*b* are slightly spaced with respect to the members 3*a*, 4*a*, so that if one positions the cap on the body so as to align the geometric axes of the orifices in the members 3*a*, 4*a*, it is impossible to pass a pivot pin through the orifices of these members without being bothered by the tabs or extensions 2*b*. When the pivot pin has been mounted in this way the hinge thus formed is bent inwardly of the lighter in the direction of the arrow F so that the two ends of the pin are now aligned with the two tabs 2*b* which are seated in the grooves 1*b*. The pin is thus immobilized against longitudinal movement.

Of course the invention may be improved in various ways. In particular, the shape of the spring may be different and the relative arrangement of its three parts may be modified, it being understood that the part acting on the head 13 is always connected either directly or through a lever to the member acting on the cap 2 so as to be displaced by movement of the cap.

While a particular embodiment of the invention has been described, it will be appreciated that it may be modified as to detail without thereby departing from the basic principles of the invention as defined by the following claims.

What is claimed is:

1. Lighter adapted to use a liquefied gas under pressure and comprising a casing, a cap for said casing movable between a closed rest position and an open rest position, a reservoir provided with a valve leading to a burner covered by said cap in said closed position, and an ignition mechanism comprising an abrasive wheel and a flint biassed against said abrasive wheel, said lighter further comprising a spring having three parts; a first part which is connected to the cap to hold it in either said open or said closed position, a second part which is adapted to be displaced by the movement of said first spring part and cooperates with said valve to open said valve during opening of said cap, and a third part which is at one end of said spring and cooperates with said flint to bias said flint against said abrasive wheel.

2. Lighter as claimed in claim 1 in which the part of the spring connected to the cap is detachably connected to said cap.

3. Lighter as claimed in claim 2 in which the cap carries a member provided with a slot removably receiving the end of said one part of the spring.

4. Lighter as claimed in claim 2 which comprises a platform traversed by the burner and surmounting the reservoir, said platform carrying said spring, a flint guide, an abrasive wheel and means for latching said platform to the casing.

5. Lighter as claimed in claim 4 in which the platform is made of a plastic material in the shape of a small block carrying a flint guide, a pivot pin for a flint lever, and said means for latching the platform to the casing.

6. Lighter as claimed in claim 5 in which the platform has at its lower end a slot through which the upper part of a flint lever extends and carries indicia near said upper part so that the displacement of said lever with respect to said indicia indicates the degree of wear on the flint.

7. Lighter as claimed in claim 4 in which the latching means comprises a rod pivotally mounted in the platform, said latching means having at its upper end means permitting its rotation and at its lower end an arm which, upon rotation of the rod, is positioned beneath an inward projection on the casing.

8. Lighter as claimed in claim 7 in which the inward projection is a part of a hinge connecting said cap to said casing.

9. Lighter as claimed in claim 1 in which the part of said spring which cooperates with said valve is a central part of said spring and has a portion which is movable with respect to said first part to actuate said valve.

10. Lighter as claimed in claim 9 in which the portion of the spring cooperating with the valve is bent.

11. Lighter as claimed in claim 1 in which said spring acts on said flint through a flint lever biassed by a part of said spring.

12. Lighter as claimed in claim 11 in which the part of the spring which is connected to the cap is an arm also connected to a coil which leads to a central portion cooperating with said valve, and said central portion leads to another coil, the end of which cooperates with the flint.

13. Lighter as claimed in claim 12 in which said second spiral part is wound around the axis of the flint lever.

14. Lighter as claimed in claim 1 in which said spring is of the torsion type.

15. Lighter as claimed in claim 1 in which a hinge connecting the cap to the casing of the lighter comprises hinge members integral with the cap and casing respectively, said hinge members being aligned to receive a pivot pin and adapted to be displaced with the pin toward the inside of the lighter so that the ends of the pin lie between two projections on the body or the cap, said pin being thereby rendered invisible.

* * * * *